US006964250B2

(12) United States Patent
Wierl et al.

(10) Patent No.: US 6,964,250 B2
(45) Date of Patent: Nov. 15, 2005

(54) INTERNAL COMBUSTION ENGINE WITH HYDRAULIC DEVICE FOR ADJUSTING THE ROTATION ANGLE OF A CAMSHAFT IN RELATION TO A CRANKSHAFT

(75) Inventors: Ulrich Wierl, Mendorf (DE); Mike Kohrs, Wilthen (DE); Rainer Ottersbach, Aurachtal (DE); Jochen Auchter, Welsendorf (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/012,882

(22) Filed: Dec. 15, 2004

(65) Prior Publication Data

US 2005/0145208 A1 Jul. 7, 2005

(30) Foreign Application Priority Data

Dec. 16, 2003 (DE) ..... 103 59 068

(51) Int. Cl.[7] ..... F01L 1/34

(52) U.S. Cl. ..... 123/90.17; 123/90.15; 123/90.31

(58) Field of Search ..... 123/90.17, 90.15, 123/90.31; 92/120–126

(56) References Cited

U.S. PATENT DOCUMENTS 6,412,462 B1 * 7/2002 Lichti et al. ..... 123/90.17

FOREIGN PATENT DOCUMENTS

| | | |
|---|---|---|
| DE | 39 37 644 A1 | 5/1991 |
| DE | 197 40 215 A1 | 3/1998 |
| DE | 101 48 687 A1 | 6/2002 |
| DE | 101 49 056 A1 | 7/2002 |
| DE | 101 34 320 A1 | 1/2003 |
| DE | 101 43 862 A1 | 3/2003 |

* cited by examiner

*Primary Examiner*—Thomas Denion
*Assistant Examiner*—Zelalem Eshete
(74) *Attorney, Agent, or Firm*—Henry M. Feiereisen

(57) ABSTRACT

A hydraulic device in an internal combustion engine for adjusting a rotation angle of a camshaft in relation to a crankshaft includes a tubular stator and a rotor connected in fixed rotative engagement with the camshaft and having plural vanes in spaced apart relationship to define pressure chambers on both sides of the vanes. The stator is connected in fixed rotative engagement with a crankshaft-drive timing pulley and formed in single-piece construction with an end wall to thereby exhibit a pot-shaped structure. The pot is made without material removal from a sheet metal part and constructed to define with the rotor vanes the pressure chambers. Pressure medium is supplied to or purged from the pressure chambers to selectively adjust the position of the rotor in relation to the stator and thereby the position of the camshaft in relation to the crankshaft.

17 Claims, 2 Drawing Sheets

INTERNAL COMBUSTION ENGINE WITH HYDRAULIC DEVICE FOR ADJUSTING THE ROTATION ANGLE OF A CAMSHAFT IN RELATION TO A CRANKSHAFT

CROSS-REFERENCES TO RELATED APPLICATIONS

This application claims the priority of German Patent Application, Serial No. 103 59 068.4, filed Dec. 16, 2003, pursuant to 35 U.S.C. 119(a)–(d).

BACKGROUND OF THE INVENTION

The present invention relates, in general, to an internal combustion engine, and more particularly to a hydraulic device of an internal combustion engine to adjust the rotation angle of a camshaft in relation to a crankshaft.

Nothing in the following discussion of the state of the art is to be construed as an admission of prior art.

German patent publication no. DE 101 34 320 A1 describes a hydraulic device for adjusting the rotation angle of a camshaft in relation to a crankshaft of an internal combustion engine. The device includes a rotor, which is configured in the form of a vane wheel secured to the camshaft by a central fastening screw, and a stator which is closed in fluid-tight manner by an end wall, which forms part of a housing in surrounding relationship to the stator, and by a timing pulley, which is driven by the crankshaft. The stator surrounds the rotor and rotates in synchronism with the timing pulley. Substantially radially extending sidewalls in the stator permit only a limited rotation angle of the rotor and form with the stator several pressure chambers which can be supplied with pressure medium or purged from pressure medium.

The components of this hydraulic device are made predominantly of steel or iron through sintering or material removing machining processes. As a result, the hydraulic device is very massive. In addition, manufacturing costs for making the sintered components by the material removal process are extensive, and undesired external oil leaks can be experienced as a consequence of the porosity of the sintered components.

Another reason for making the components of hydraulic devices heavy and massive is the belief that thin wall thicknesses in sintering metallurgy would cause problems as far as density distribution, strength and stiffness are concerned, especially when the wall thickness fluctuates, and that complex shapes with different fill heights can normally be realized only by using expensive slides in the tool. Hydraulic devices made by a material removing process encounter similar problems. In other words, complex shapes to suit the load at hand can be made only by a complicated machining process.

One approach to reduce the mass of the hydraulic device involves the manufacture of components of the hydraulic device from aluminum or aluminum alloy or a different lightweight metal. Examples for this approach include German patent publication nos. DE 101 48 687 A1 or DE 101 34 320. This approach has, however, the drawback that the leakage gap increases in view of the presence of different thermal expansion coefficients when the components heat up, resulting in excessive leaking. Moreover, aluminum is subjected to greater deformation than steel or iron under load when same dimensions are involved. In particular, the use of screw fasteners to bolt the individual parts together requires the provision of large enough gaps to accommodate the deformation. The need for screw fasteners, however, not only also complicates the assembly and incurs added costs but also adversely affects the force flux.

It would therefore be desirable and advantageous to provide an improved device of an internal combustion engine for adjusting the rotation angle of a camshaft in relation to a crankshaft, to obviate prior art shortcomings and to accomplish an overall mass reduction while effectively minimizing leakage.

SUMMARY OF THE INVENTION

According to one aspect of the present invention, in an internal combustion engine, a hydraulic device for adjusting an angle of rotation of a camshaft in relation to a crankshaft includes a rotor connected in fixed rotative engagement with the camshaft and having plural vanes in spaced apart relationship to define pressure chambers on both sides of the vanes, a stator connected in fixed rotative engagement with a crankshaft-driven timing pulley and formed in single-piece construction with an end wall to thereby exhibit a unitary pot-shaped structure, said pot-shaped structure being made without material removal from a sheet metal part and constructed to bound with the vanes the pressure chambers, and a hydraulic system for feeding pressure medium to or purging pressure medium from the pressure chambers.

The present invention thus resolves prior art problems by replacing massive sintered components with thin-walled sheet metal parts for demarcating the pressure chambers on the driving side. It is to be understood by persons skilled in the art that the term "sheet metal" is used here in a generic sense and the principles described in the following description with respect to sheet metal are equally applicable to other materials such as band which generally follows the concepts outlined here. For convenience and sake of simplicity, the following description refers only to sheet metal.

The number of sintered components being produced is thus decreased while the material removal process is simplified and the risk of external oil leaks is reduced as a result of the absence of porous sintered parts. Although the stator and the housing are manufactured by a non-cutting process, it will be appreciated by persons skilled in the art that machining processes may in certain situations become desirable for finishing works.

A reduction of oil leaks is also realized by the single-piece construction of the stator and the end wall. Thus, there is no need for a joining area between these parts so that the need for separate seals is eliminated. The single-piece configuration also reduces the number of components and simplifies the manufacture because of the absence of a separate connection between the stator and the end wall. Also the occurrence of compressive deformations is reduced when compared with force-fitting axial bolted connections.

In order to provide the hydraulic device with the necessary stiffness and load-bearing capability despite the lower mass, the thin-walled sheet metal parts can be locally shaped or profiled along load directions such as to best suit encountered loads, so that there is no need for providing greater wall thicknesses and to accept resultant higher mass. The reduction in mass in accordance with the present invention can thus be realized without encountering different thermal expansion coefficients of components so that leakage due to thermal effects cannot take place.

According to another feature of the present invention, the stator may include segments which extend axially from the bottom-forming end wall in circumferential spaced-apart relationship and are separated from one another by cutouts.

The cutouts are bounded by inner walls which interconnect the segments. Each segment is made by a non-cutting shaping process and has opposite sidewalls connected by an outer wall, with the inner walls and the outer walls of the segments extending in circumferential direction in concentric relationship, whereby the pressure chambers are demarcated by the sidewalls and the outer walls of the segments. The sidewalls interconnect hereby the two ends of neighboring inner and outer walls and extend substantially radially.

The single-piece construction of the stator and the end wall to form the pot-shaped structure is also able to at least substantially dampen or even entirely eliminate the generation of radial forces as a result of oscillations. Thus, the need for a housing to surround the pot-shaped structure can be eliminated to further reduce the overall mass of the device.

The attachment of the pot-shaped structure of stator and end wall, without surrounding housing, to the timing pulley may be realized by providing flanges to bound the cutouts on the side distal to the end wall. The flanges are connected to the timing pulley and may be provided with throughbores to allow bolting of the pot-shaped structure to the timing pulley. This type of flange configuration is advantageous because of the compact structure of the pot-shaped structure, with the surfaces of the flanges imparting additional stability through mutual support of the pressure chambers. Suitably, the securement between the stator and the timing pulley can be implemented by appropriate connection techniques, including force-locking, form-fitting or friction engagements. Examples include knurling, collaring, welding, swaging, riveting, gluing, or inwardly turned locking lugs.

The pot-shaped structure of stator and end wall may be made from a sheet metal blank through deep drawing. The inner and outer circumferential walls and the sidewalls may hereby be formed through a radial deep drawing process. In order to realize a precise right angle between the stator walls of the pot-shaped structure and the end wall, and thus to be able to completely seal the pressure chambers, a washer may be disposed directly adjacent to the end wall. Thus, the pressure chambers have sides abutting at a right angle, after the rotor with its vanes has been installed. Leakage losses are therefore avoided. The washer may be profiled from thin-walled steel and so conformed to the size and shape of the pot-shaped structure as to seal the pressure chambers in a fluid-tight manner anteriorly of the end wall. The washer may further contribute to the stability of the pot-shaped structure, when firmly connected to the stator.

As an alternative to the provision of a washer for securement to the end wall, it may also be conceivable to inject material into the space on the side of the camshaft anteriorly of the end wall to thereby accomplish a substantially planar and right-angled sealing of the pressure chambers in relation to the sidewalls and the outer circumferential walls. Injected material may be plastic or other liquid material which solidifies subsequently and remains solid during operation.

According to another feature of the present invention, the cutouts between the sidewalls may be filled with insets of plastic or metal to thereby further reinforce and stiffen the pot-shaped structure.

According to another feature of the present invention, an angle limitation unit may be provided to restrict the rotation angle of the rotor. In this way, the wall thickness of the sidewalls of the stator can further be reduced by preventing the vanes of the rotor to impact the sidewalls in their respective end positions and thereby apply pressure. The angle limitation unit may be realized by forming the rotor with a pin for engagement in a corresponding slotted guide of the timing pulley.

A hydraulic device according to the present invention is lightweight and easier to manufacture (less material removal) as a result of a decreased number of components so that manufacturing costs are reduced and the assembly is simplified. The need for previously required impregnation with synthetic resin or vapor treatment for sealing sintered material is eliminated as provision of sintered material is no longer required. The number of joining areas is reduced so that the need for seals is decreased and leaks are minimized.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
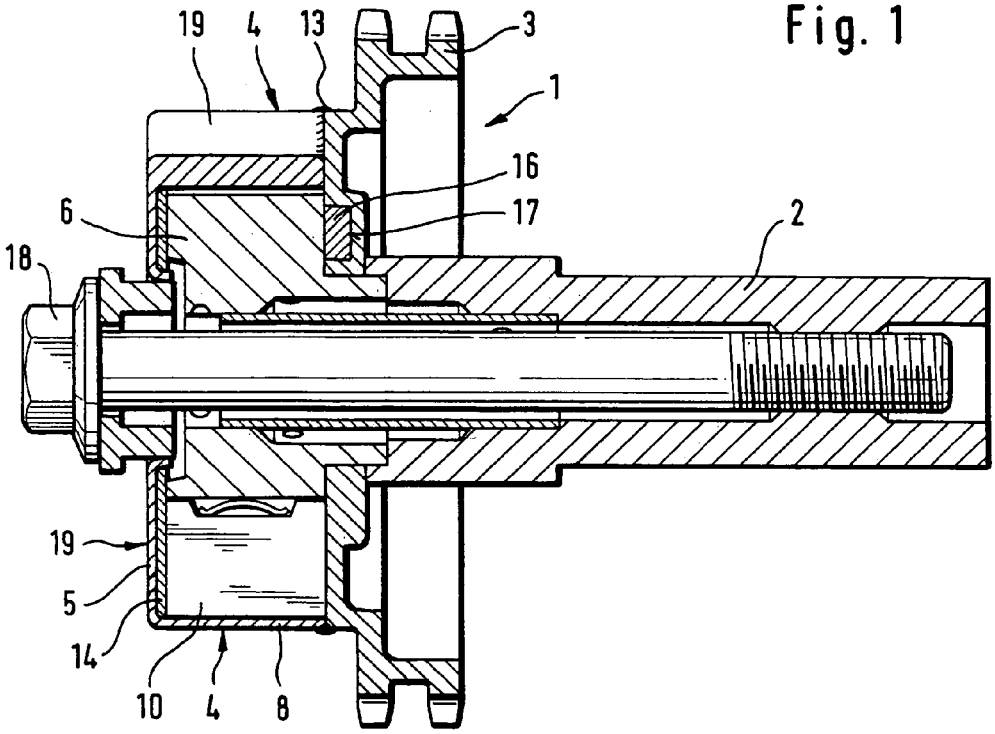
FIG. 1 is a longitudinal section of a first embodiment of a device for rotation angle adjustment according to the present invention.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

This is one of two applications both filed on the same day. Both applications deal with related inventions. They are commonly owned and have the different inventive entity. Both applications are unique, but incorporate the other by reference. Accordingly, the following U.S. patent application is hereby expressly incorporated by reference: "INTERNAL COMBUSTION ENGINE WITH HYDRAULIC DEVICE FOR ADJUSTING THE ROTATION ANGLE OF A CAMSHAFT IN RELATION TO A CRANKSHAFT".

Turning now to the drawing, and in particular to FIG. 1, there is shown a longitudinal section of a first embodiment of a hydraulic device according to the present invention, generally designated by reference numeral 1, for adjusting the rotation angle of a camshaft 2 in relation to a crankshaft (not shown). The hydraulic device 1 is implemented as a hydraulic actuator for varying the opening and closing times of gas exchange valves of an internal combustion engine and is operated by a timing pulley 3 which may be connected via a not shown chain to the crankshaft. The hydraulic device 1 includes essentially a tubular stator 4, which is firmly secured to the timing pulley 3, and a rotor 6, which is connected in fixed rotative engagement via an axial central screw 18 to the camshaft 2 and is constructed in the form of a vane wheel having vanes 10. The stator 4 is constructed in one piece with an end wall 5 to thereby exhibit overall a pot-shaped structure, generally designated by reference numeral 19 and referred to in the following description as "pot". The pot 19 in conjunction with the timing pulley 3 seals the hydraulic device 1 in a fluid-tight manner.

As a consequence of the single-piece construction of the stator 4 and the end wall 5 as pot 19, there is thus no joining area between the stator 4 and the end wall 5. The connection between the timing pulley 3 and the stator 3 is realized by a welded seam 13.

Figure 2:
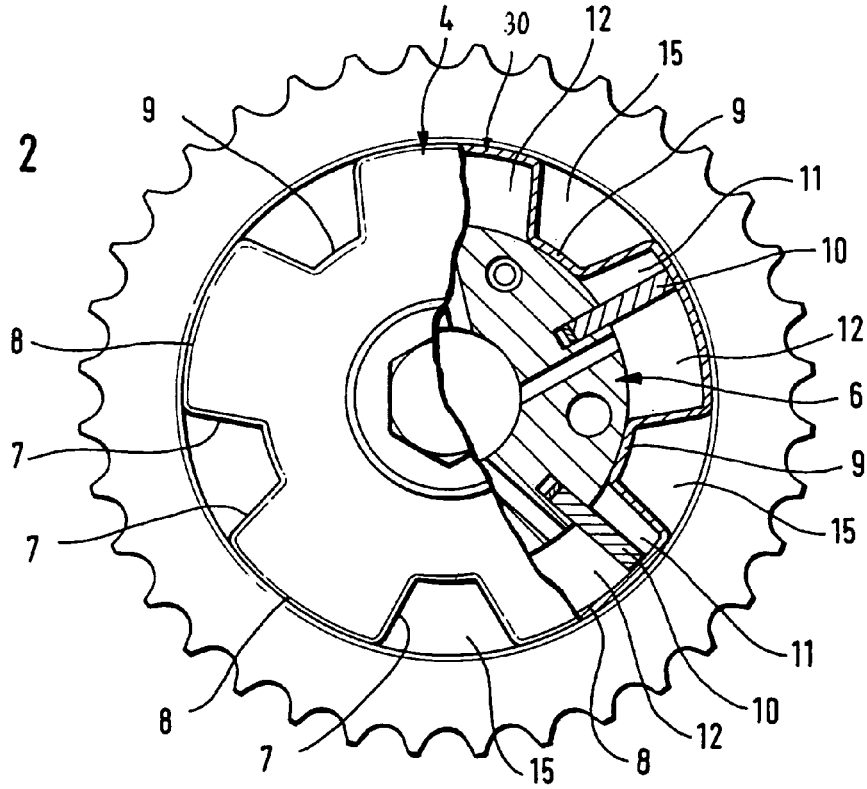
FIG. 2 is a plan view of the device of FIG. 1, partly broken open to show internal parts of the device.

Referring now to FIG. 2, there is shown a plan view of the hydraulic device 1, partly broken open to show internal parts. The stator 4 includes a plurality of circumferential spaced-apart segments which are generally designated by reference numeral 30 and extend axially inwards from the end wall 5. The segments 30 are interconnected by integral inner walls 9 which form a base for cutouts 15 bounded between the segments 30. Each segment 30 includes opposite sidewalls 7 and an outer wall 8 which connects the rotor-distal ends of the sidewalls 7 and extends circumferentially in concentric relationship to the inner walls 9. The vanes 10 of the rotor 6 project out in radial direction and rest against the inside wall surface of the outer walls 8 of the segments 30, thereby subdividing the space, defined by each segment 30 and the rotor 6 and its vanes 10, into a first pressure chamber 11 and a second pressure chamber 12 which can be selectively charged with hydraulic fluid to effect a movement of the rotor 6 in relation to the stator 4 and thus a desired angular position. In other words, the force transfer is such that when the pressure chambers 11, 12 are selectively or simultaneously charged with hydraulic fluid, the rotor 6 undergoes a rotation relative to or is fixed with respect to the stator 4 and the timing pulley 3. This causes the camshaft 2 to rotate likewise in relation to the crankshaft of the internal combustion engine.

On the side of the camshaft 2, the pressure chambers 11, 12 are closed by the timing pulley 3, while being closed on the camshaft-distal side by the end wall 5 of the pot 19.

The pot 19 comprised of stator 4 and end wall 5 is made form a sheet metal blank through a deep drawing process. The inner and outer circumferential walls 8, 9 and the sidewalls 7 can hereby be formed through a radial deep drawing process.

In order to limit the rotation of the rotor 6, a stopper 16 (FIG. 1) in the form of a pin is in connection with the rotor 6 for engagement in a corresponding slotted guide 17 in the form of a circular ring shaped groove in the timing pulley 3. By restricting the rotation of the rotor 6, stress on the stator 4 and the pot 19 can be significantly reduced.

Figure 3:
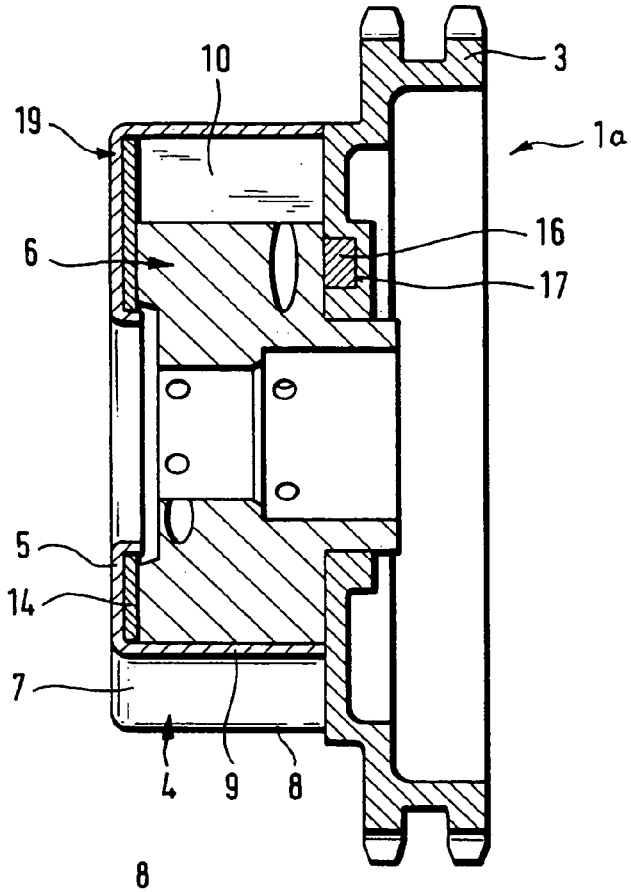
FIG. 3 is a longitudinal section of a second embodiment of a device for rotation angle adjustment according to the present invention.

Referring now to FIG. 3, there is shown a longitudinal section of a second embodiment of a hydraulic device for rotation angle adjustment according to the present invention, generally designated by reference numeral 1*a*. Parts corresponding with those in FIG. 1 are denoted by identical reference numerals and not explained again. The description below will center on the differences between the embodiments. In this embodiment, provision is made for a sealing disk or washer 14 which is placed inside the pot 19 and rests against the end wall 5 on the camshaft proximal side. The washer 14 is hereby configured to conform to the inner contour of the pot 19. The provision of the washer 14 is intended for those situations in which the transition from the stator 4 to the end wall 5 of the pot 19 does no define a precise right angle so as to reduce leakage losses.

Figure 4:
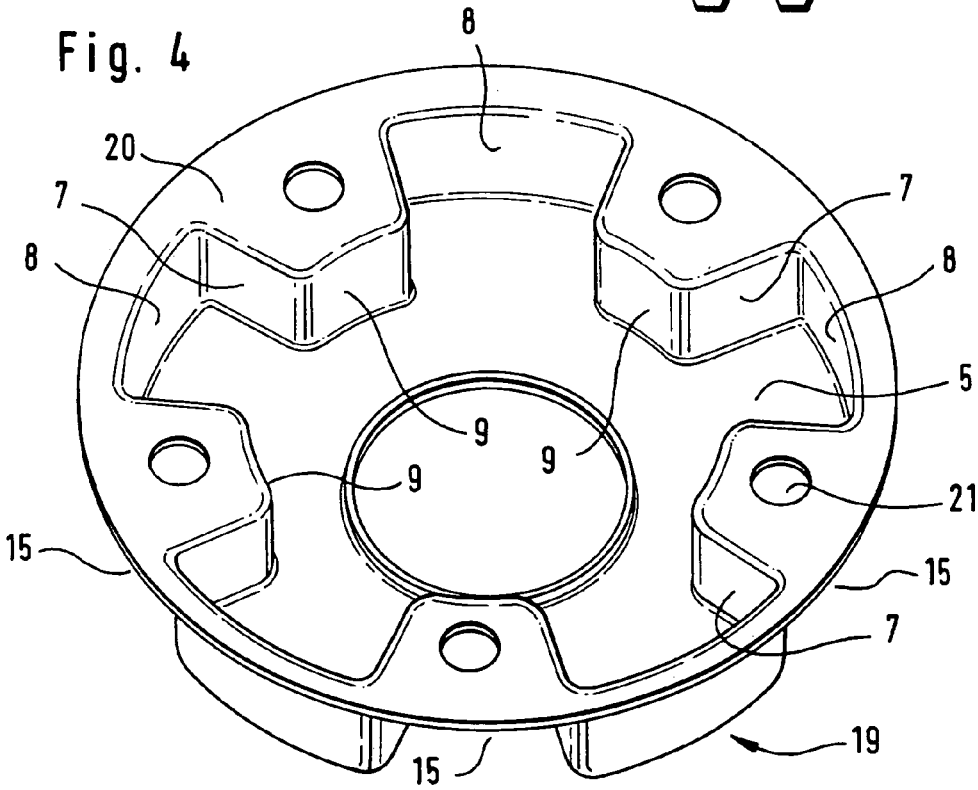
FIG. 4 is a perspective view of a modified pot-shaped stator assembly for a device for rotation angle adjustment according to the present invention.

FIG. 4 is a perspective view of a modified pot 19 for a hydraulic device for rotation angle adjustment according to the present invention. The pot 19 is provided on the side of the camshaft 2 with flanges 20 which bound the cutouts 15 and have bores 21 for receiving fasteners (not shown) by which the pot 19 is connected in force-locking engagement with the timing pulley 3. The flanges 20 provide hereby a mutual support of the pressure chambers 11, 12 and stiffen the pot 19.

As result of the single-piece construction of the stator 4 and the end wall 19 to form the pot 19, the number of components is reduced and the assembly simplified. In addition, leakage loss is reduced as a joining area is omitted, and the absence of porous sintered components eliminates the need for complex water vapor treatment or synthetic resin impregnation.

The stator 4 can be made, e.g. by using band material to form a sheet metal strip of desired thickness, width and length of e.g. more than 100 meter which is wound onto a coil which is mounted to a press. The press draws in the band material and cuts pieces of desired length for subsequent production of stators 4 through a non-cutting process, as described above. The press has die of a contour corresponding to the inner contour of the stator. As a result of the pressing operation, the radially inwardly areas of the pot 19 are forced in axial direction inwards and thus shifted in relation to the areas with the bores 21. Thus, the end wall 5 extends thus offset in axial direction to the areas with the bores 21, while forming the sidewalls 7 and circumferential walls 8, 9.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. In an internal combustion engine, a hydraulic device for adjusting an angle of rotation of a camshaft in relation to a crankshaft comprising:

a rotor connected in fixed rotative engagement with the camshaft and having plural vanes in spaced apart relationship to define pressure chambers on both sides of the vanes;

a stator connected in fixed rotative engagement with a crankshaft-driven timing pulley and formed in single-piece construction with an end wall to thereby exhibit a unitary pot-shaped structure, said pot-shaped structure being made without material removal from a sheet metal part and constructed to bound with the vanes the pressure chambers; and a hydraulic system for feeding pressure medium to or purging pressure medium from the pressure chambers.

2. The hydraulic device of claim 1, wherein the stator includes segments extending axially from the end wall in circumferential spaced-apart relationship and separated from one another by cutouts bounded by inner walls interconnecting the segments, with each segment being made by a non-cutting shaping process and having opposite sidewalls connected by an outer wall, with the inner walls and the outer walls of the segments extending in circumferential direction in concentric relationship, said pressure chambers being demarcated by the sidewalls and the outer walls of the segments.

3. The hydraulic device of claim 2, wherein the sidewalls interconnect proximal ends of neighboring inner and outer walls and extend substantially radially.

4. The hydraulic device of claim 2, and further comprising insets for reinforcement or support of the cutouts.

5. The hydraulic device of claim 4, wherein the insets are made of plastic or metal.

6. The hydraulic device of claim 1, wherein the pressure chambers are sealed at a right angle on one end surface by material applied upon the end wall.

7. The hydraulic device of claim 6, wherein the material is a washer constructed to match a stator contour.

8. The hydraulic device of claim 7, wherein the washer is profiled from thin-walled steel and so conformed to size and shape of the pot-shaped structure as to seal the pressure chambers in a fluid-tight manner anteriorly of the end wall.

9. The hydraulic device of claim 7, wherein the washer is firmly connected to the stator.

10. The hydraulic device of claim 1, wherein the pressure chambers are sealed on one end surface by plastic injection-molded onto the end wall.

11. The hydraulic device of claim 1, and further comprising an angle limitation unit for limiting the angle of rotation of the rotor, said angle limitation unit including a pin engageable in a corresponding slotted guide.

12. The hydraulic device of claim 11, wherein the slotted guide is formed in the timing pulley.

13. The hydraulic device of claim 1, wherein the stator is made from a sheet metal blank through a deep-drawing process.

14. The hydraulic device of claim 1, wherein the cutouts are closed by flanges on a side distal to the end wall, with the flanges forming part of the stator.

15. The hydraulic device of claim 14, wherein the flanges have openings for receiving fasteners.

16. The hydraulic device of claim 1, wherein the stator and the timing pulley are securely connected to one another.

17. The hydraulic device of claim 16, wherein the stator and the timing pulley are securely connected to one another by a process selected from the group consisting of knurling, collaring, welding, swaging, riveting, gluing, and inwardly turned locking lugs.

* * * * *